US006524184B1

(12) United States Patent
Lind et al.

(10) Patent No.: US 6,524,184 B1
(45) Date of Patent: Feb. 25, 2003

(54) MULTI-LEVEL LOTTERY-TYPE GAMING SYSTEM WITH PLAYER-SELECTED SECOND LEVEL GAME

(75) Inventors: Jefferson C. Lind, Austin, TX (US); Joseph R. Enzminger, Austin, TX (US); David Shapiro, Austin, TX (US); Clifton Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 09/479,975

(22) Filed: Jan. 10, 2000

(51) Int. Cl.[7] ..... A63F 9/24
(52) U.S. Cl. ..... 463/13; 463/16; 463/20
(58) Field of Search ..... 463/16, 13, 17, 463/18, 20; 273/269, 138.1, 138.2, 139

(56) References Cited

U.S. PATENT DOCUMENTS 4,494,197 A 1/1985 Troy et al.
5,042,809 A 8/1991 Richardson
5,092,598 A 3/1992 Kamille
5,324,035 A 6/1994 Morris et al.
5,407,199 A * 4/1995 Gumina ..... 273/139
5,595,538 A * 1/1997 Haste, III ..... 463/17
5,871,398 A * 2/1999 Schneier et al. ..... 463/16
5,931,468 A * 8/1999 Orolin ..... 273/139
5,980,385 A * 11/1999 Clapper, Jr. ..... 463/17
6,024,640 A 2/2000 Walker et al.
6,126,542 A * 10/2000 Fier ..... 463/16

* cited by examiner

*Primary Examiner*—Michael O'Neill
*Assistant Examiner*—Julie Brocketti
(74) *Attorney, Agent, or Firm*—Russell D. Culbertson; Shaffer & Culbertson, L.L.P.

(57) ABSTRACT

A gaming method according to the invention utilizes a first level game and a plurality of second level or daughter games. Each game at a particular level comprises a separate lottery-type game having a number or plurality of game records. Each game record includes a predetermined result. According to the invention, each first level game result is associated with a single value common to the result in each other first level game record. However, the result associated with each second level game record varies between various predetermined prize values.

10 Claims, 4 Drawing Sheets

| | |
|---|---|
| 0 | No Winning Hand |
| 1 | Jacks or Better |
| 2 | Two Pair |
| 3 | Three of a Kind |
| 4 | Straight |
| 5 | Flush |
| 6 | Full House |
| 7 | Four of a Kind |
| 8 | Straight Flush |
| 9 | Royal Flush |

FIG. 2

| Game/Cards Held | Second Round Game | Possible Prizes |
|---|---|---|
| **Zero Cards Held** | | |
| Game 1 | No Cards | 0,1,2,3,4,5,6,7,8,9 |
| **One Card Held** | | |
| Game 2 | Card is Ten or Higher | 0,1,2,3,4,5,6,7,8,9 |
| Game 3 | Card is Two through Nine | 0,1,2,3,4,5,6,7,8 |
| **Two Cards Held** | | |
| Game 4 | Pair of Jacks or Better | 1,2,3,6,7 |
| Game 5 | Pair of Tens or Lower | 0,2,3,6,7 |
| Game 6 | Suited, Both Ten or Higher | 0,1,2,3,4,5,6,7,9 |
| Game 7 | Suited, Close at Least One Below Ten | 0,1,2,3,4,5,6,7,8, |
| Game 8 | Suited, Far | 0,1,2,3,5,6,7 |
| Game 9 | Unsuited, Close | 0,1,2,3,4,6,7 |
| Game 10 | Unsuited, Far | 0,1,2,3,6,7 |
| **Three Cards Held** | | |
| Game 11 | Three of a Kind | 3,6,7 |
| Game 12 | Pair of Jacks or Better | 1,2,3,6,7 |
| Game 13 | Pair of Tens or Lower | 0,2,3,6,7 |
| Game 14 | Suited, all Ten or Higher | 0,1,2,3,4,5,9 |
| Game 15 | Suited, Close, at Least One Below Ten | 0,1,2,3,4,5,8 |
| Game 16 | Suited, Far | 0,1,2,3,5 |
| Game 17 | Unsuited, Close | 0,1,2,3,4 |
| Game 18 | Unsuited, Far | 0,1,2,3 |
| **Four Cards Held** | | |
| Game 19 | Four of a Kind | 7 |
| Game 20 | Three of a Kind | 3,6,7 |
| Game 21 | Two Pair | 2,6 |
| Game 22 | Pair of Jacks or Better | 1,2,3 |
| Game 23 | Pair of Tens or Lower | 0,2,3 |
| Game 24 | Suited, all Ten or Higher | 0,1,4,5,9 |
| Game 25 | Suited, Close, at Least One Below Ten and at Least One Jack or Higher | 0,1,4,5,8 |
| Game 26 | Suited, Close, all Below Jack | 0,4,5,8 |
| Game 27 | Suited, Far, at Least One Jack or Higher | 0,1,5 |
| Game 28 | Suited, Far, all Below Jack | 0,5 |
| Game 29 | Unsuited, Close, at Least One Jack or Higher | 0,1,4 |
| Game 30 | Unsuited, Close, all Below Jack | 0,4 |
| Game 31 | Unsuited, Far, at Least One Jack or Higher | 0,1 |
| **Five Cards Held** | | |
| Game 32 | Royal Flush | 9 |
| Game 33 | Straight Flush | 8 |
| Game 34 | Four of a Kind | 7 |
| Game 35 | Full House | 6 |
| Game 36 | Flush | 5 |
| Game 37 | Straight | 4 |
| Game 38 | Three of a Kind | 3 |
| Game 39 | Two Pair | 2 |
| Game 40 | Jacks or Better | 1 |

FIG. 3

MULTI-LEVEL LOTTERY-TYPE GAMING SYSTEM WITH PLAYER-SELECTED SECOND LEVEL GAME

TECHNICAL FIELD OF THE INVENTION

This invention relates to games of chance and, more particularly, to lottery-type games which provide for active player participation. The invention encompasses a gaming method, an apparatus through which the game may be played, and a program product for implementing the game.

BACKGROUND OF THE INVENTION

Lottery-type games are popular sources of revenue for governmental agencies and charitable organizations. As used in this disclosure, a "lottery-type game" comprises a game having a predetermined number of payouts or prizes and a determined chance of winning. For example, a lottery-type game may comprise a scratch-off or pull-tab game having a number of pre-printed tickets. Each ticket has some type of printed result indicator which indicates if the particular ticket is a winning ticket and, if the ticket is a winning ticket, indicates the prize or payout. The result indicator is commonly covered with some opaque cover material which may be scratched off or otherwise removed to reveal the indicator below. Thus, the ticket purchaser cannot see if the ticket is a winning ticket until purchasing the ticket and removing the opaque cover material.

Prior lottery-type games suffer from the fact that the games require no player involvement other than simply uncovering the result indicator to find the predetermined prize or payout. Thus, prior lottery-type games lack the player excitement generated in casino-type games of chance such as draw poker and black jack, for example, which require active player participation and some level of player skill.

In recognition of this disadvantage of lottery-type games, some of these games are made to resemble casino-type games. For example, each result indicator on a scratch-off game may comprise a representation of a draw poker hand. Winning tickets in this type of scratch-off game may include a result indicator which represents a traditional winning poker hand such as a straight, flush, or full house, for example. These lottery-type games use illustrations related to casino-type games in an effort to create a sense of excitement in the lottery-type game similar to the excitement associated with the depicted casino-type game. However, in spite of these illustrations in lottery-type games, the games remain essentially passive, with little player involvement.

SUMMARY OF THE INVENTION

It is an object of the invention to provide a gaming method which provides for active player involvement while maintaining the predetermined chances of winning along with the verifiable, predetermined payouts which are characteristic of lottery-type games. Further objects of the invention include providing a gaming apparatus and a program product for implementing the gaming method.

A gaming method according to the invention utilizes a first level game and a plurality of second level or daughter games. Each game at a particular level comprises a separate lottery-type game having a number or plurality of game records. Each game record includes a predetermined result. Thus, the first level game includes a plurality of first level game records and each first level game record includes a first level game result. According to the invention, each first level game result is associated with a single value common to the result in each other first level game record. However, the result associated with each second level game record varies between various predetermined prize values. For example, the game result associated with a particular second level game record may comprise a winning result which is associated with a prize or payout, or may comprise a losing result not associated with any prize or payout.

Regardless of the number of different games at each particular level, each game at a particular level comprises a separate lottery-type game. The game records for each game level according to the invention may be developed by any suitable means including prior art means for generating or manufacturing lottery-type games.

According to the invention, the first level game record provides a player with a basis for making some permissible response from a set of permissible responses. This set of permissible responses preferably comprises possible plays in a casino-type game which the multi-level lottery-type game simulates. Each permissible response corresponds to one particular second level game in the plurality of second level games. When a player makes a permissible response to the first level game, the response effectively enters the player in the second level game corresponding to the permissible response which the player has made. The player then receives a game record from the particular second level game, and the result of this second level game record comprises the result of the multi-level game. Since the player chooses their response from the set of permissible responses, the player effectively chooses the second level game in which they participate.

In the preferred form of the invention, the game records are implemented as electronic data structures and the games are played through a player terminal. In addition to a suitable display, the terminal includes a player input device which enables the player to make game play requests, such as the initial request to participate in the first level game and the permissible responses which enter the player in the second level games. The player input device may also allow the player to make other types of inputs not directly related to the play of the games. A communication arrangement is included in the apparatus for facilitating communications between the player terminal and a game record storage device which stores the game records.

In the course of play, a player is enabled to view a first level game representation which is defined by the result of a particular first level game record. Where the invention is implemented using a player terminal having a suitable display device, a first level game representation comprises some graphic representation displayed on the player terminal in response to a first level play request which the player has entered through the terminal. In this example, the player receives the first level game record through the terminal and is enabled to view the first level game representation when the terminal displays the game representation. Regardless of the manner in which the first level game representation is displayed, the game representation may include some graphical representation related to a traditional casino-type game. The first level game representation may, for example, comprise a graphical representation of a draw poker hand. The representation is defined by the received game record in that the result included in the record dictates a type of representation which must be displayed. For example, where the game is implemented to simulate draw poker, a first level record may include a result corresponding to a "full house." In this example, the game record result dictates that the graphical representation comprise some collection of cards showing a full house.

Once a player is enabled to view a first level game representation associated with a particular first level record, the player must, in a preferred form of the invention, participate in one of the second level games. The player participates in a second level game by making one of the permissible responses. A particular permissible response causes the player to receive a second level game record from a pool of records making up the particular second level game corresponding to the response. Similarly to the first level game record, the received second level game record dictates a second level game representation which indicates the result included in the record. The game player is enabled to view the second level game representation through the player terminal. Any prize associated with the received second level record may be paid at the terminal, may appear as a credit at the terminal, or may be handled in any other suitable fashion.

The multiple second level games corresponding to permissible responses to a first level game facilitate greater player participation in the games. Each game, however, remains strictly a lottery-type game with a predetermined payout or prize for each game record, similar to the predetermined prize or payout for each ticket of a traditional scratch-off or pull-tab game. Thus, the games are readily verifiable and avoid the variability in total payout which is characteristic of casino-type games. Yet the game representations associated with each game record according to the invention may be related to a casino-type game so that it appears to the player that they are participating in a casino-type game rather than a lottery-type game.

In the electronic form of the invention, the player terminal has associated with it a play control arrangement for controlling the play of the game. The play control arrangement may comprise software instructions executed on a processor at the terminal or a processor associated with the terminal. This play control software includes first level game code which causes the player terminal to display a first level game representation in response to a first level play request initiated by the player at the player terminal. Second level game program code included in the game control software causes the player terminal to respond to a permissible response made through the terminal. The terminal responds to such a permissible response by displaying a second level game representation associated with a particular second level game record.

These and other objects, advantages, and features of the invention will be apparent from the following description of the preferred embodiments, considered along with the accompanying drawings.

BRIEF DESCRIPTION OF THE DRAWINGS

FIG. 2 is a table showing potential results associated with both levels of games in a preferred implementation of the invention.

FIG. 3 is a table showing the second level games in a preferred implementation of the invention, and also showing potential results associated with each particular second level game.

DESCRIPTION OF THE PREFERRED EMBODIMENTS

Figure 1:
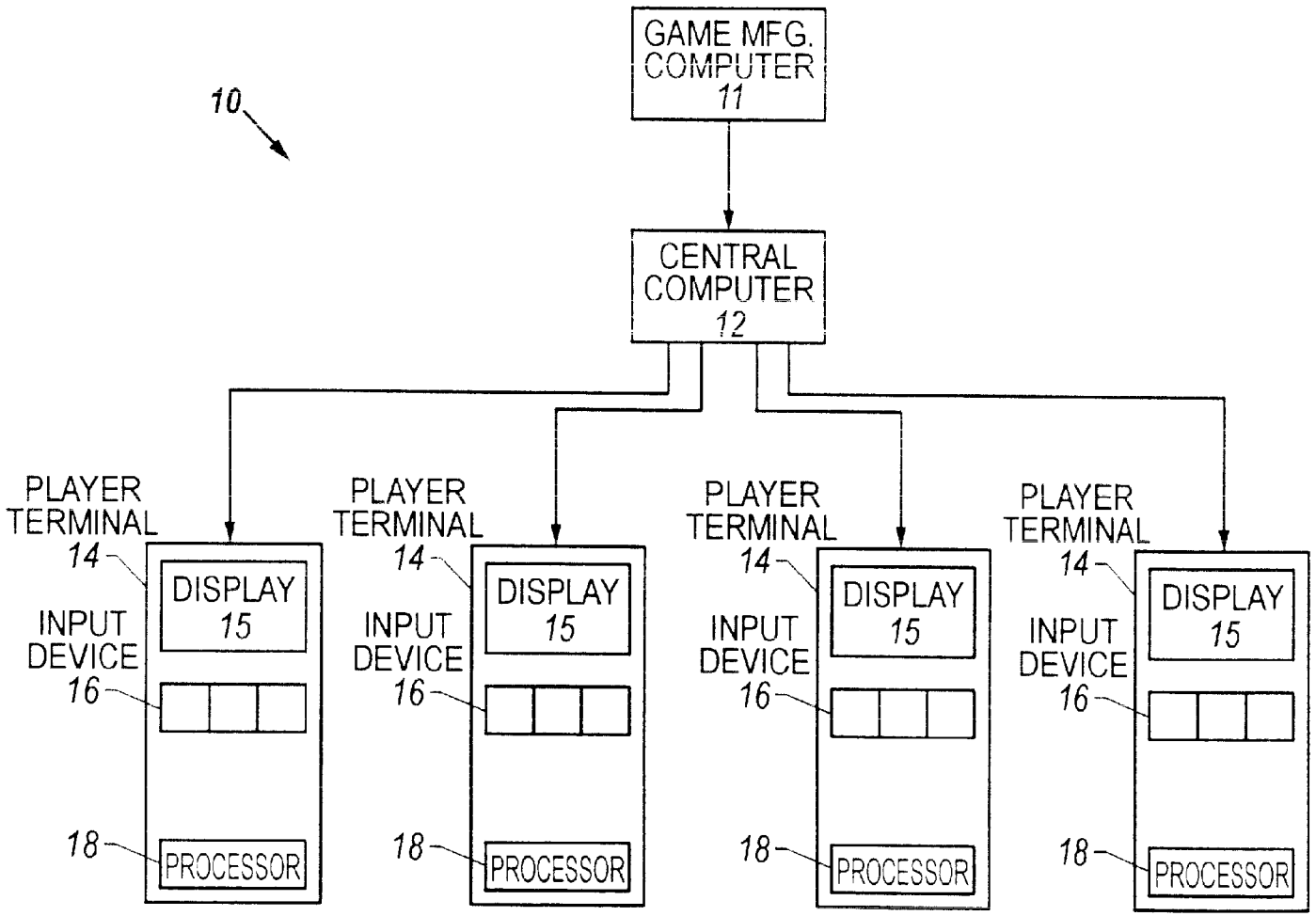
FIG. 1 is a diagrammatic representation of a gaming apparatus embodying one preferred form of the invention.

FIG. 1 shows a gaming apparatus 10 embodying the principles of the invention. The form of the invention shown in FIG. 1 is adapted to implement a gaming method illustrated in FIGS. 2, 3, and 4. As will be discussed with particular reference to FIGS. 2 and 3, the gaming method employs two levels of lottery-type games, including a single first level game and many different second level games. Each game is played with a number or plurality of game records which, in this implementation of the invention, each comprise electronic data structures.

The game records are created at a game manufacturing computer system 11 and then stored in a storage device associated with a central computer system 12. Central computer system 12 is connected to communicate via suitable means with a plurality of player terminals 14. Although four player terminals 14 are shown in FIG. 1 for purposes of illustrating the invention, any number of player terminals may be included in an apparatus embodying the principles of the invention.

Each player terminal 14 includes a display 15 for displaying various game representations, and further includes an input device 16 for receiving player inputs including game play requests. The input device may comprise any type of input arrangement including one or more push button, key, or lever activated switches. Also, the input device may comprise a touch screen and thus be integrated with display 15. Although not shown in the drawings, each player terminal 14 may also include an arrangement for receiving payments from a player and an arrangement for making payouts to the player. Payouts may be made using a coin or token dispensing arrangement (not shown) included in player terminal 14. Alternatively, or in addition to a coin dispensing arrangement, player terminal 14 may include a printer (not shown) for printing a ticket showing the player's winnings. The player may redeem this ticket through a game operator, for example. In yet other arrangements, winnings may be tracked through a suitable game monitoring system in communication with system 10, and a player may obtain winnings from an operator in control of the game monitoring system.

The player terminals 14 shown in FIG. 1 also include a processor 18 for executing game control software which implements the gaming method. Other forms of the invention may perform some or all of this game play processing at a central computer system such as system 12. The invention is not limited to any particular processing arrangement, and any processing arrangement which performs the gaming method described in this disclosure is to be considered an equivalent to the illustrative processing arrangement shown in FIG. 1.

Game records for the different games used in the invention may be generated by any suitable means. For example, once a desired quantity of each potential result is determined for a particular game, that number of game records for each result may be generated by a suitable method. Each record includes some information which indicates, or may be used to indicate, if the particular record is a winning or losing record. That is, each record includes some means for indicating a particular result associated with the record. For example, each record may include a record identifier, a result, and a game representation. Alternatively, each game record may include only a record identifier. In this latter form of game record, the result and perhaps other information associated with the record may be maintained in separate tables or other data structures which are accessed using the game record identifier. Regardless of how the game records for each game are manifested, once the records are generated, they may be shuffled or otherwise randomized electronically in a separate randomization step. Both the game record generation and randomization may be performed at a separate game manufacturing system such as system 11 shown in FIG. 1.

The randomized game records may be arranged in groups, and groups of randomized game records may be transferred for distribution or sale to one or more separate computer systems such as the central computer system 12 shown in FIG. 1. These groups of randomized game records are analogous to books of scratch-off tickets distributed to lottery retailers. As will be discussed in detail below with reference to FIGS. 2, 3, and 4, the randomized game records for each game are distributed sequentially to the various player terminals 14. This sequential distribution is analogous to the distribution of scratch-off tickets by a retailer. In the illustrated form of the invention, central computer 12 includes a storage device such as a hard drive (not shown separately) for storing the game record data structures required in a particular implementation of the invention. Central computer 12 may also include programming for performing various accounting and verification functions associated with the play of the game.

Those skilled in the art will appreciate that the invention may be embodied in many arrangements other than the illustrative arrangement shown in FIG. 1. For example, a single computer system may generate the game records according to the invention and may also store the game records for distribution to several player terminals such as terminals 14. Alternatively, a single computer system could perform the game record generation function, the game record storage function, and player interaction function, thus replacing the separate systems 11, 12, and 14 shown in FIG. 1. These alternative arrangements are to be considered equivalent to the arrangement shown in FIG. 1. Furthermore, rather than randomizing an entire set of game records and then distributing the records sequentially, the game records could be drawn randomly and distributed from a sequentially arranged set of records. This alternative game record randomization technique is to be considered within the scope of the invention as set forth in the following claims.

Figure 4:
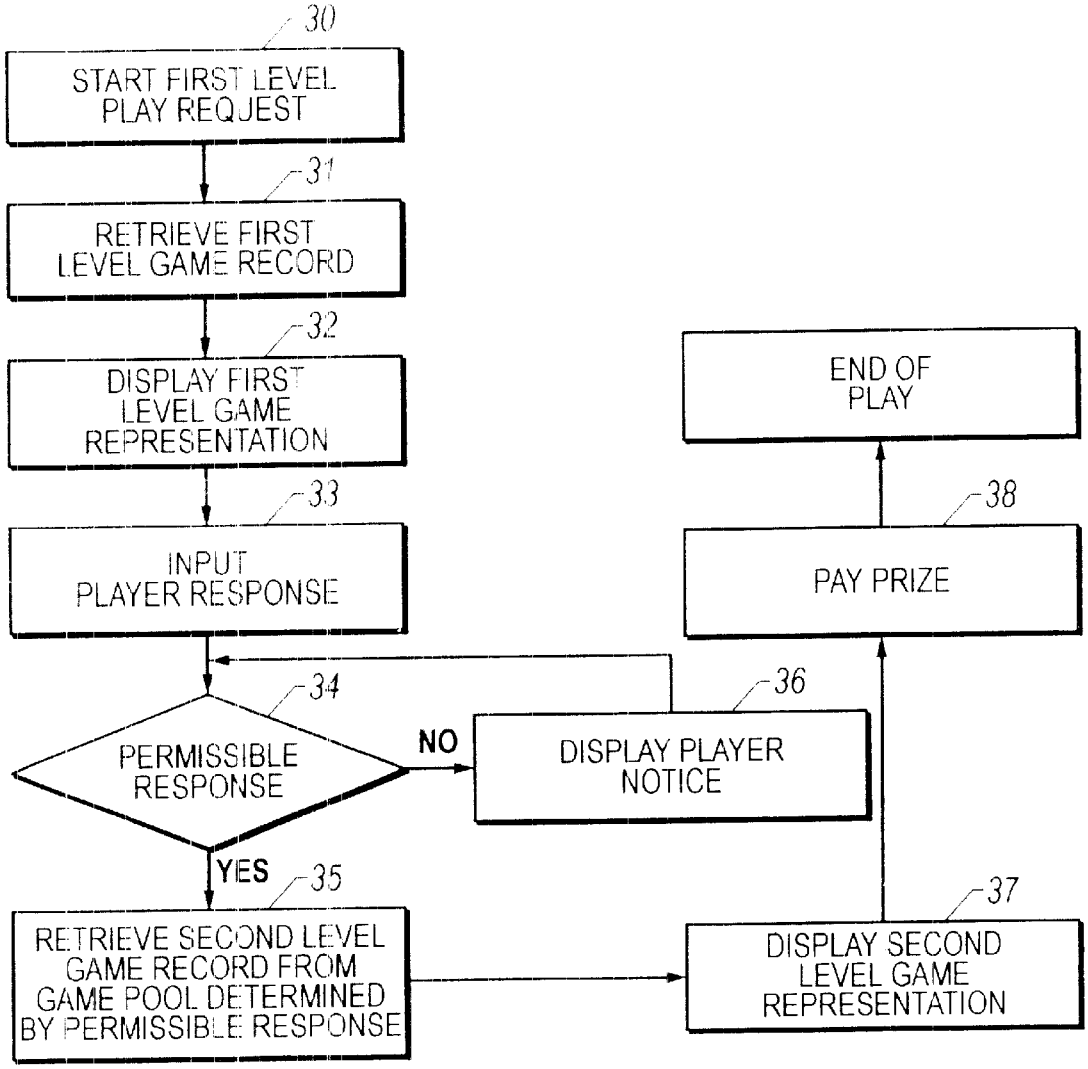
FIG. 4 is a flow chart illustrating a gaming method embodying the principles of the invention and using the games and results shown in FIGS. 2 and 3.

FIGS. 2, 3, and 4 may be used to describe a gaming method according to the invention which may be implemented through the apparatus 10 shown in FIG. 1. FIG. 2 lists the potential results and associated game representations for each first and second level game. FIG. 3 lists each second level game along with the possible results for each second level game. FIG. 4 shows the process steps performed in the illustrative gaming method. In this form of the invention, the gaming method employs the two game levels to imitate a traditional draw poker casino-type game. Each game representation comprises a representation of five poker cards. This particular gaming method does not employ game representations which include a representation of a dealer's hand. However, the gaming method may be modified easily to give the player the appearance of playing against a dealer.

The illustrated gaming method employs a single first level game, and forty separate second level games. As shown in FIG. 3, each second level game corresponds to a permissible player response made or entered after the player receives the first level game record. The set of "permissible responses" comprises all the responses a player is allowed to make in the game in terms of the number of cards held from a first level game representation, and which particular cards are held. The first level game may be referred to as the "initial deal" game. The forty second level games listed in FIG. 3 are named according to the number of cards that the player holds after the first level game, and the nature of those cards.

Referring now to FIG. 4, the gaming method starts with an initial player request shown at reference numeral 30. The initial player request may comprise a first level play request which the player enters through input device 16 associated with a particular terminal 14 shown in FIG. 1. Commonly the player will be required to make a payment in some manner through terminal 14 in order to enable the terminal to act on the play request. This payment represents the player's buy-in to the multi-level game. A preferred implementation of the invention allows the player to buy-in at any of several different amounts, one to five coins for example. The properly enabled terminal 14 responds to the first level play request by fetching or retrieving a particular first level game record from the game record storage device (not shown) which may, for example, be associated with the central computer system 12 in FIG. 1. This first level game record retrieval step is shown at process block 31 in FIG. 4. At process block 32 display device 15 then displays the first level game representation defined by the particular first level game record which has been retrieved. Displaying the first level game representation at display 15 enables the player to view the first level game representation and thereby determine the outcome associated with the particular record. It will be noted that the particular first level game record is retrieved sequentially from the game records still available in the particular game. However, the player preferably has no way of knowing how many game records are still available in the first level game or what prizes have already been paid out in the game. For this reason, and by virtue of the fact that the records generated in a game are all associated with a fixed result, the first level play request according to the invention is analogous to the purchase of a scratch-off lottery ticket.

The first level result associated with the retrieved first level game record may be any of the results shown in FIG. 2. For example, the result of the retrieved first level game record may indicate a straight flush. In this case the first level game representation comprises a graphical representation of a "straight flush." This graphical representation was displayed at step 32 after the particular record was retrieved. As another example, the result of the retrieved first level game record fetched at step 31 may comprise a "no winning hand" shown in FIG. 2. In this case, the first level game representation displayed at display 15 comprises a graphical representation of a hand having no apparent value, for example, a five card hand having only a pair of "nine" cards.

The game representations themselves are preferably generated from software instructions residing at the displaying device and called or invoked by information included in the respective game record. In this preferred case, the implementing software includes game representation generation code for generating the various game representations based on information in the retrieved game records. This game representation generation code may determine the specific cards to be displayed in a hand. However, the hand is constrained by the result included in the retrieved record. For example, a "full house" result shown in FIG. 2 dictates that the game representation comprise a full house, but the game representation generation code may determine which cards are displayed to produce the full house.

Regardless of the first level game result included in the retrieved first level game record, the payout or value of the first level game result is always equal to a common value, preferably the value of the player's buy-in at the start of the game. The final payout from the game is solely determined by the result included in the second level game record retrieved from a particular one of the various second level game sets. The purpose of the first level game is to enable the player to view a first level game representation and take some desired action in response to that representation. That player response is input at process block 33 in FIG. 4, and comprises the player's selection of cards to hold from the first level game representation and thus the selection of cards to discard. Of course, the "cards" which the player selects to hold are graphic representations of cards shown on the display 15 and included in the first level game representation.

As shown at decision block 34 in FIG. 4, if the player makes a permissible response, that is, a response corresponding to one of the second level games described in FIG. 3, the game proceeds to block 35. As indicated at process block 35, the gaming method according to the invention then includes the step of retrieving a second level game record from the second level game determined by the permissible response which the player input at process block 33.

If the player enters a response at block 33 that is not a permissible response, then the process branches to block 36 to display a notice to the player that they have chosen a response that is not allowed. The impermissible responses in the preferred form of the invention are limited to those responses in which the player has no opportunity to win. In the illustrated example, a player may not hold all five cards if those cards do not include a winning combination, and may not hold four cards if there is no winning combination in the held cards, no possibility of a straight or flush, and there are no held cards higher than ten.

Once a player has input a permissible response at block 33 and the second level game record has been retrieved at block 35, the process according to the invention includes displaying the second level game representation defined by the result included in the particular second level game record which has been retrieved. This second level displaying step is shown at process block 37 in FIG. 4. Similar to the representation displayed at step 32, the second level game representation comprises a representation of five cards. This representation includes the cards held in accordance with the player's input at block 33 and a number of new cards equal to the number of cards discarded according to the player's input at block 33.

The result which may be associated with the second level game record is chosen from the results shown in FIG. 2 as appropriate for the second level game shown in FIG. 3. For example, game "4" shown in FIG. 3 comprises the second level game dictated when the player holds a pair of jacks or better from the first level game representation. In this case, the possible outcomes of the second level game are results 1, 2, 3, 6, and 7 shown in FIG. 2. As another example, game "5" from FIG. 3 comprises the second level game dictated when the player holds a pair of tens or lower from the first level game representation. In this case, the possible outcomes of the second level game are results 0, 2, 3, 6, and 7 shown in FIG. 2. In the description of the second level games shown in FIG. 3, the word "close" means all of the cards in a representation are close enough in rank that a straight is possible and "far" means that there is too much of a range for the payer to draw a straight. "Suited" means that a flush is possible from the cards held by the player, and "unsuited" means that cards from two or more suits are held according to the permissible response input at 33.

Once the second level game representation is displayed at process block 37, the gaming method proceeds to block 38 at which point the appropriate prize or payout is paid or credited to the player in some suitable fashion. The game then ends and the terminal is initialized for another game sequence beginning again at process block 30.

Each game record retrieval step, steps 31 and 35 in the form of the invention illustrated in FIG. 4, is performed by a game play control arrangement comprising first and second game level software code or instructions executed by a processor associated with the gaming apparatus. Similarly, the game representation displaying steps 32 and 37, decision step 34, and payout step 38 are all performed by software instructions or under the control of software instructions.

It will be apparent from the method set out in FIG. 3, that the invention provides a major advantage over prior lottery-type games, particularly when implemented in a computer-based apparatus such as that shown in FIG. 1. In the computer-based apparatus 10 shown in FIG. 1, the method of the invention may be implemented so that it appears to the player that they are participating in a regular casino-type game in which results are randomized for each individual play and the outcome of each play is uncertain. Regardless of this appearance, the player is in fact only participating in the first and second level lottery-type games each having a fixed set of available game records, with each record having a predetermined, readily verifiable result.

An example play will help further illustrate the principles of the invention. Assume that in response to a first level play request made at block 33 in FIG. 4, a first level game record is retrieved at block 32 which includes result "3" in FIG. 2, defining a first game representation comprising a five card poker hand having three of the same card (three of a kind). The player may wisely choose to hold the three like cards by their input at block 33, and this permissible response enters the player into the second level game "11" shown in FIG. 3. The possible results include results 3, 6, and 7 shown in FIG. 2. That is, it will appear to the player that they have drawn to three of a kind, a full house, or four of a kind. It will be understood that the player is preferably free to make a permissible response which is not the best response. For example, assume the three like cards included in the first level game representation comprise the nine of diamonds, nine of hearts, nine of clubs, and the other cards include the eight of diamonds and the seven of diamonds. In this example, the player may choose to hold the nine, eight, and seven of diamonds and discard the nine of hearts and nine of clubs. This permissible response enters the player in game 15 shown in FIG. 3. The possible results included in the records which make up this game are results 0, 1, 2, 3, 4, 5, and 8 described in FIG. 2. In the event a player makes an unwise permissible response, the gaming method may include the step of notifying the player of the unwise choice in some fashion through the terminal through appropriate notification program code. However, such notification is unnecessary to practice the present invention.

The above described preferred embodiments are intended to illustrate the principles of the invention, but not to limit the scope of the invention. Various other embodiments and modifications to these preferred embodiments may be made by those skilled in the art without departing from the scope of the following claims. For example, although it is an advantage of the invention that the gaming method may be implemented to mimic a casino-type game, the game representations which are displayed may be designed so that it is apparent to the player that they are playing lottery-type games. Also, although the invention is illustrated above with reference to poker, the game representations according to the invention may be designed to imitate other types of casino games or any other type of game.

What is claimed is:

1. A gaming method comprising the steps of:

(a) developing a plurality of first level game records for a first level game, each first level game record including a first level game result which defines a particular first level game representation, each first level game record being associated with a respective first level game record value, each respective first level game record value comprising the same value;

(b) developing a plurality of second level game records for each of a plurality of second level games, each second level game record for a particular second level game including a second level game result, and each second level game corresponding to a different one of a plurality of first level permissible player responses which may be entered by a game player;

(c) enabling a game player to view a first level game representation defined by a particular one of the first level game records; and (d) in response to the entry of one of the permissible player responses by a game player, displaying a second level game representation defined by a game record from a particular one of the second level games, the particular one of the second level games corresponding to the respective permissible player response entered by the game player.

2. The method of claim 1 wherein:

(a) the steps of developing a plurality of first level game records and developing a plurality of second level game records are performed at a game manufacturing processor; and (b) the step of displaying the second level game representation comprises displaying the second level game representation at a player terminal remote from the game manufacturing processor.

3. The method of claim 2 wherein the game player makes the entry of the permissible player response at the player terminal.

4. The method of claim 1 wherein the first level game representation is a representation of a casino-type game.

5. A gaming method utilizing a plurality of first level game records for a first level game, and further utilizing a plurality of second level games, each second level game having a plurality of second level game records and corresponding to a different one of a plurality of first level permissible player responses, wherein the plurality of first level game records and the plurality of second level game records for each second level game are predetermined and stored prior to game play in the first level game, the method comprising the steps of:

(a) enabling a game player to view a first level game representation defined by a particular one of the first level game records, each first level game record being associated with a common first level game record value; and (b) in response to one of the permissible player responses, displaying a second level game representation defined by a game record from a particular one of the second level games, the particular one of the second level games corresponding respective permissible player response entered by the game player.

6. The method of claim 5 wherein:

(a) the step of displaying the second level game representation comprises displaying the second level game representation at a player terminal.

7. The method of claim 6 wherein the game player makes the permissible player response at the player terminal.

8. A gaming apparatus comprising:

(a) a game record storage device for (i) storing a plurality of first level game records for a first level game, each first level game record including a first level game result and being associated with a common first level game record value, and for (ii) storing a plurality of second level game records for each of a plurality of second level games, each second level game record including a second level game result, each second level game corresponding to a different permissible player response;

(b) a player terminal having a player input arrangement;

(c) a communication arrangement for facilitating communications between the game record storage device and the player terminal; and (d) a play control arrangement for (i) causing the player terminal to display a first level game representation associated with a particular one of the first level game records, the first level game representation being displayed in response to a first level play request initiated at the player terminal and being defined by the particular one of the first level game records, and for (ii) causing the player terminal to respond to a permissible player response at the player terminal by displaying a particular one of the second level game representations defined by a particular second level game record which is associated with a particular second level game corresponding to the respective permissible player response.

9. A program product adapted to be executed by a processor associated with a game player terminal, the program product being stored on a computer readable medium and comprising:

(a) first game level program code for responding to a first level play request by causing the player terminal to display a first level game representation defined by a particular one of a plurality of first level game records for a first level game, each first level game record being associated with a respective first level record value, each respective first level record value comprising the same value; and (b) second game level program code for responding to a permissible player response by causing the player terminal to display a second level game representation defined by a particular one of a plurality of second level game records, the particular one of the second level game records being included in a particular second level game corresponding to the permissible player response.

10. The program product of claim 9 wherein:

(a) each second level game record is included in one of a plurality of second level games;

(b) the permissible player response is included in a plurality of permissible player responses; and (c) each different second level game corresponds to a different one of the plurality of permissible player responses.

* * * * *

UNITED STATES PATENT AND TRADEMARK OFFICE

CERTIFICATE OF CORRECTION

PATENT NO. : 6,524,184 B1
DATED : February 25, 2003
INVENTOR(S) : Jefferson C. Lind et al.

It is certified that error appears in the above-identified patent and that said Letters Patent is hereby corrected as shown below:

Column 9,
Line 63, after "corresponding" add -- to the --

Signed and Sealed this

Twenty-second Day of July, 2003

JAMES E. ROGAN
*Director of the United States Patent and Trademark Office*